United States Patent [19]

Hoeckelman

[11] 4,085,013

[45] Apr. 18, 1978

[54] CHROMIUM PLATING PROCESS EMPLOYING MANGANESE DIOXIDE COATED ANODES

[75] Inventor: Ralph F. Hoeckelman, Irwin Borough, Pa.

[73] Assignee: United States Steel Corporation, Pittsburgh, Pa.

[21] Appl. No.: 801,486

[22] Filed: May 31, 1977

Related U.S. Application Data

[63] Continuation-in-part of Ser. No. 291,857, Sep. 25, 1972, abandoned.

[51] Int. Cl.[2] ..... C25D 3/04

[52] U.S. Cl. ..... 204/51; 204/290 R

[58] Field of Search ..... 204/290 R, 105 R, 51, 204/290 F; 291/887

[56] References Cited

U.S. PATENT DOCUMENTS

| | | | |
|---|---|---|---|
| 1,510,172 | 9/1924 | Hosenfeld | 204/290 R X |
| 1,544,451 | 6/1925 | Hambuechen | 204/51 |
| 3,616,302 | 10/1971 | Osawa et al. | 204/290 F X |

FOREIGN PATENT DOCUMENTS

| | | | |
|---|---|---|---|
| 274,913 | 1929 | United Kingdom | 204/51 |
| 289,823 | 2/1971 | U.S.S.R. | 204/290 F |

OTHER PUBLICATIONS

Frederick A. Lowenheim, "Modern Electro-Plating", pp. 87–94, 99–102, (1968).

*Primary Examiner*—G. L. Kaplan
*Attorney, Agent, or Firm*—Arthur J. Greif

[57] ABSTRACT

In the electrodeposition of Cr, certain disadvantages of the conventional lead or lead alloy anode are overcome by employing an overlying coating of $MnO_2$. The $MnO_2$ coating may also be employed on other base metal electrodes, as well.

4 Claims, No Drawings

CHROMIUM PLATING PROCESS EMPLOYING MANGANESE DIOXIDE COATED ANODES

This application is a continuation-in-part of application Ser. No. 291,857, filed Sept. 25, 1972 and now abandoned.

This disclosure relates to manganese dioxide coated electrodes, and more particularly to the use of manganese dioxide coated anodes in chromium plating baths.

The electrodeposition of Cr in various oxidation states (e.g. Cr, $Cr^{+3}$, $Cr^{+6}$) is widely employed for both decorative and protective applications. For the most part, these electrolytic processes are conducted using electrodes made of lead or lead alloys. Although they are widely used, these lead base anodes suffer from a number of disadvantages [see, for example, D. W. Hardesty, "Plating", vol. 56, No. 6, June 1969, pp. 705–709 and Lowenheim, "Modern Electroplating", Chapter or Chromium, pp 87–102 (1968)] primarily due to the formation of an electrolytically insulating coating during periods of idleness. As shown by Lowenheim, lead anodes coated with lead peroxide tend to become passive, requiring electrolysis with full tank voltage for a significant period of time in order to achieve reactivation. Other known methods for reconditioning such coated Pb anodes are equally time consuming and expensive. Materials, other than lead, have been used to a lesser extent, but with very limited success. Iron and chromium dissolve in the plating bath, thus effecting undesirable changes in the bath composition. Carbon reacts strongly with the bath and is consumed too rapidly in most plating processes. Precious metal anodes such as palladium, or precious metal surfaces such as platinized titanium have found only limited usefulness.

It is therefore an object of this invention to provide an electrode for use in Cr plating, which is highly efficient and yet relatively inert to the electrolyte.

Another object of this invention is to provide an anode for use in Cr plating which does not exhibit the significant deactivation problem attendant the use of Pb anodes.

In the following specific examples, a 4 inch × 8 inch × 1/16 inch steel plate was employed as the base metal for preparation of experimental anodes. The plate was thoroughly cleaned, dipped into a 50% solution of $MN(NO_3)_2$ and cured in a muffle furnace for 10 minutes at 400° C. The process was repeated five times to build up a satisfactorily thick $MnO_2$ coating. In initial tests, these anodes were compared with similar size, conventional lead anodes in the same plating bath. This bath, containing 60 g $CrO_3$/1, 0.8 g HF/1 and 0.9 $H_2SO_4$/1 was operated at 100° F with a cathode current density of 330 amps/ft$^2$. After an idle period of about one minute, the lead anodes evidenced the buildup of a noticeable insulating layer, while the $MnO_2$ coated anodes showed no sign of undesirable layer formations. After this period of idleness in the coating bath, the efficiency of the anodes was measured for both a one second and a three second plating sequence. Results are reported below:

| | Plating Efficiency - Percent | |
|---|---|---|
| | One second sequence | Three second sequence |
| $MnO_2$ Anode | 18 | 18 |

-continued

| | Plating Efficiency - Percent | |
|---|---|---|
| | One second sequence | Three second sequence |
| Lead Anode | 14 | 16 |

The above anodes were then employed in a bath of similar concentration for a continuous five-hour plating test. During this period, the weight loss of the $MnO_2$ coated anodes were less than 1 gm., and their plating efficiency had increased to 23%. (During the five-hour period, 14 gms. of $CrO_3$ was added to replace that lost by electrodeposition.) Similar successful tests were also run in more acidic plating baths employing up to 250 g $CrO_3$/1, up to 2.9 g $H_2SO_4$/1 and 2.6 g $H_2SiF_6$/1. It is clear, therefore, that these anodes may be employed in any conventional Cr plating bath, i.e. those containing from 10 to 500 g $CrO_3$/1, in combination with any of the large number of different catalyst systems now employed by the industry.

Additional sets of $MnO_2$ coated anodes were prepared for pilot line testing. In this case, lead was used as the base metal. The lead anodes were coated by swabbing the surface with a 50% Mn $(NO_3)_2$ solution and then heating to 250° C for 10 minutes in humid air. The process was repeated until a coat thickness of about fifty mils was achieved. Pilot line trials were operated for several weeks at current densities of 700 to 3000 amps/ft$^2$. During this period, there was no sign of the formation of an insulating film (a condition which materially decreases efficiency). Similarly, there was no significant deterioration of the anodes by electrolyte dissolution. The $MNO_2$ coated anodes of this invention were thereafter installed in commercial TFS plating tanks and compared with conventional lead anodes, for an approximately six month trial evaluation. The conventional lead anodes, when subjected to idle times varying from about 1 to 7 days, were deactivated to such an extent that each grid would only be capable of conducting currents of the order of 3000 amperes, compared with their normal (active) current conducting capability of well in excess of 4000 amperes. Such deactivated anodes required more than 2 hours of operation at full tank voltage to even approach their active conductivity. By contrast, the $MnO_2$ coated anodes which were subjected to similar idle times of about 1 to 7 days, essentially instantaneously achieved start-up plating currents in excess of 4000 amperes. This difference in passivation behavior is especially significant in the operation of a commercial TFS electroplating line, since the 2 hour deactivation time of lead anodes often results in the production of stained product. Such staining is caused by the deposition of excessive chromium oxide, which deposition is favored at lower current densities. Consequently, the use of $MnO_2$ coated anodes has resulted in less poor quality stained glass being produced during the first few hours of the re-start of electroplating.

$MnO_2$ can be pyrolyzed from solutions of $Mn(NO_3)_2$ at temperatures of about 150°–500° C. In the case of a lead base, the $MnO_2$ coating should be sufficiently thick to act as an effective barrier to the diffusion of chromium ions and thereby prevent the formation of an insulating film of lead chromate. When other base materials are employed, the minimum thickness of $MnO_2$ is that which will effectively impede the dissolution of the base. In either case, the $MnO_2$ layer should not be so thick that it will readily spall off. It was found that for the various base materials examined, coating thicknesses of from about 5 to 100 mils permitted easy handling while providing adequate protection against chromium ion diffusion.

I claim:

1. In the plating of a metal article with a chromium containing coating, comprising:

immersing said article in an aqueous, acidic electrolyte containing chromic acid at a concentration of 10 to 500 g/l, and applying an electric current from an electromotive source connected to said article and to an anode element, said current being sufficient to reduce a desired amount of said chromium ions at the surface of said article to effect the plating thereof, the improvement which comprises, employing as said anode element an electrically conductive base material, the active surface of which is substantially covered with an overlying coating of conductive $MnO_2$.

2. The method of claim 1, wherein the thickness of said overlying coatings ranges from about 5 to 100 mils.

3. The method of claim 2, wherein said metal article is a ferrous base alloy and said conductive base material is a lead base alloy.

4. The method of claim 3, wherein the magnitude of said applied current is 700 to 3,000 amps/ft$^2$ of said article surface.

* * * * *